US006066011A

United States Patent [19]

Day

[11] Patent Number: 6,066,011

[45] Date of Patent: May 23, 2000

[54] THRUSTER

[75] Inventor: Terence Robert Day, Coombabah, Australia

[73] Assignee: Jetfan Australia Pty. Ltd., Queensland, Australia

[21] Appl. No.: 09/051,257

[22] PCT Filed: Sep. 4, 1996

[86] PCT No.: PCT/AU96/00546

§ 371 Date: Feb. 23, 1998

§ 102(e) Date: Feb. 23, 1998

[87] PCT Pub. No.: WO97/09234

PCT Pub. Date: Mar. 13, 1997

[30] Foreign Application Priority Data

Sep. 4, 1995 [AU] Australia ..... PN5188

[51] Int. Cl.[7] ..... B63B 35/58

[52] U.S. Cl. ..... 440/38

[58] Field of Search ..... 440/38, 47; 60/221, 60/222; 407/196, 197, 179, 176, 198; 239/DIG. 7

[56] References Cited

U.S. PATENT DOCUMENTS

| | | | |
|---|---|---|---|
| 3,047,208 | 7/1962 | Coanda | 417/176 |
| 3,566,823 | 3/1971 | Hope-Gill . | |
| 5,074,759 | 12/1991 | Cossairt | 417/198 |

FOREIGN PATENT DOCUMENTS

| | | |
|---|---|---|
| 2013308 | 5/1994 | Russian Federation . |
| 2055726 | 2/1980 | United Kingdom . |
| 2201733 | 2/1987 | United Kingdom . |
| 2233037 | 11/1989 | United Kingdom . |
| 2243602 | 3/1990 | United Kingdom . |
| 2271389 | 10/1993 | United Kingdom . |

*Primary Examiner*—Ed Swinehart
*Attorney, Agent, or Firm*—Hoffman, Wasson & Gitler

[57] ABSTRACT

A thruster such as a marine thruster has a fluid inlet, a fluid outlet, a shroud, a fluid passageway, and an internal toroidal body around which recirculating fluid passes at high speed, the recirculating fluid causing the incoming fluid to be accelerated through to the fluid outlet.

19 Claims, 1 Drawing Sheet

THRUSTER

TECHNICAL FIELD

This invention relates to a thruster for use in fluids and particularly relates to a marine thruster used to propel water vehicles.

BACKGROUND ART

Fluid thrusters for use in marine applications conventionally comprise external propellers, or jet propulsion where water passes into an internal impeller. External propellers are well-known, have a number of problems including efficiency, and problems with wake.

Impellers, such as used in jet boats, consist of an internal flow tube having a forward inlet through which water passes. The impeller rotates at high speed in the flow tube and propels the water through the flow tube and to the outlet. An advantage of the jet propulsion thrusters is that there is little likelihood of propeller damage in shallow water.

OBJECT OF THE INVENTION

It is an object of the invention to provide a thruster such as marine thruster comprising an internal impeller where the impeller does not directly contact and accelerate incoming fluid. In one form, the invention resides in a thruster comprising a forward fluid inlet, a rear fluid outlet and an internal fluid passageway through which fluid flows and is accelerated, a curved body positioned between the fluid inlet and fluid outlet and about which fluid can circulate, the curved body having a forward portion adjacent the forward fluid inlet and which is dimensioned to provide a lower pressure surface to the fluid circulating about the curved body, a rear portion adjacent the rear fluid outlet and which is dimensioned to provide a higher pressure surface to the fluid circulating about the curved body, an outer portion between the forward portion and the rear portion and which is in fluid communication with the fluid passageway, an inner portion, and fluid acceleration means to accelerate the fluid about the curved body.

Thus, the thruster has a fluid acceleration means which accelerates fluid about the curved body, and the fluid recirculating around the curved body causes acceleration of incoming fluid passing through the forward fluid inlet.

The curved body may be in the form of a doughnut or toroid. The curved body need not be totally symmetrical and may be slightly elliptical in cross-section. The curved body need not be entirely curved in two directions and portions of the curved body may be straight if desired. If the curved body is in the form of a doughnut or toroid, a central passage is formed. Fluid passing through the central passage in the curved body and over the forward portion will exhibit a reduction in pressure as it passes over the forward portion which is a surface of increasing surface area, and which can also be seen as a lower pressure surface. As the fluid passes over this area, along the outer portion and back into the central portion, it passes over the rear portion which has a surface of decreasing surface area thereby fluid passing along it will undergo an increase in pressure, and therefore this portion can be seen as a higher pressure surface relative to the forward portion.

If the curved body is toroidal or doughnut shaped, and therefore has an annular-type appearance, it is preferred that the forward fluid inlet is also annular such that fluid can pass over all parts of the curved body. Similarly, it is preferred that the rear fluid outlet is annular which may improve the efficiency of the thruster.

In order to further improve the efficiency of the thruster, a tapering rear after portion may be positioned behind the rear fluid outlet such that fluid existing from the outlet passes over and exerts pressure on the tapered after portion.

The curved body can be positioned in the thruster between the forward fluid inlet and the rear fluid outlet in such a manner that the outer portion only and possibly some of the forward and rear portions contact incoming fluid while the inner portion contacts only recirculating fluid.

The fluid acceleration means may be positioned within the central passage formed by the toroid or doughnut shaped curved body. The fluid acceleration means can comprise an impeller or any other suitable type of drive. The impeller can be driven by a motor and the motor may be positioned within the thruster, for instance within the tapered after portion. Alternatively, the fluid acceleration means can be driven from an external motor such as a motor on a water vessel to which the thruster is attached.

The forward portion of the curved body is preferably associated with a fluid flowing slot. The fluid blowing slot may be annular if the curved body is doughnut is toroidal shaped. The fluid blowing slot may be positioned adjacent the forward portion such that fluid being blown out of the fluid blowing slot passes over the forward portion which provides a low pressure surface. It is also preferred that the fluid blowing slot is positioned adjacent the incoming fluid stream.

The thruster may further include a fluid flow divider. The fluid flow divider may be positioned adjacent the rear portion of the curved body and can function to divide or split fluid passing through the internal fluid passageway into a first recirculating portion which recirculates about the curved portion and a second remaining portion which passes over or around the fluid flow divider and towards the rear fluid outlet.

The thruster can be used as a marine thruster such that the incoming fluid is water. The recirculating fluid is also preferably a liquid, although it could also comprise a mixture of liquid in gas, or a gas, for instance steam.

BEST MODE

Figure 1:
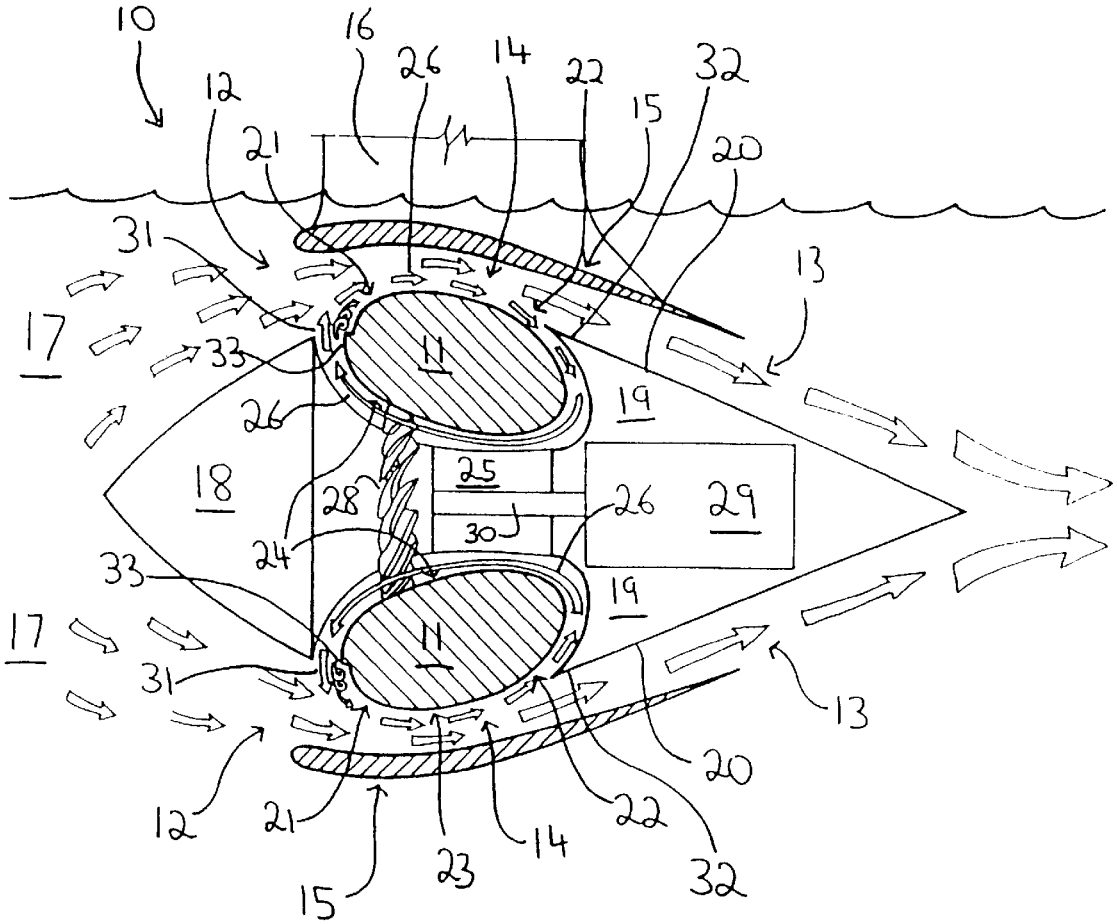
FIG. 1 is a section view of a thruster according to an embodiment of the invention.

Referring to FIG. 1, there is shown a thruster 10 which in the embodiment is exemplified as a marine thruster. The thruster uses the principle of the coanda effect. Thruster 10 has an internal curved body 11 which in the embodiment is toroidal or doughnut shaped. Forward of curved body 11 is a forward fluid inlet 12 which is annular in shape and therefore can be seen as an annular inlet slot. Rearward of curved body 11 is a rear fluid outlet 13 which in the embodiment is also annular in shape and thus can be seen as an annular outlet slot.

Between inlet 12 and outlet 13 is an internal fluid passageway 14 which is also annular in configuration. Passageway 14 has an outer wall defined by a shroud 15. Shroud 15 can be attached to a support plate 16 which can be attached to a water vessel (not shown), either in a fixed manner or in a pivotal manner such that thruster 10 can be moved in and out of the water.

To assist flow of water 17 into fluid inlet 12, a forward entry cone or nose cone 18 is provided to deflect the water towards the annular inlet slot 12.

A tapered after portion 19 is provided at the rear of the thruster. Tapered after portion 19 provides the inner surface 20 of the annular rear outlet slot 13 which is defined by inner surface 20 and a rear portion of shroud 15.

Tapered after portion 19 improves the efficiency of the thruster, as accelerated fluid passing through outlet 13 exerts a pressure on the tapered after body 19 which translates into a forward thrust.

Curved body 11 need not be perfectly symmetrical and may be slightly elliptical as illustrated in FIG. 1. Curved body 11 sits within the thruster to protect the body from damage. Curved body 11 has a forward portion 21, a rear portion 22, an outer portion 23 and an inner portion 24. By being toroidal or doughnut shaped, curved body 11 has an internal passageway 25. Fluid accelerating about curved body 11 passes over forward portion 21 and by virtue of the curved body being doughnut shaped or toroidal, this forward portion presents an increasing surface area to the fluid passing over it, and therefore can be seen as a lower pressure surface. That is, fluid passing over this portion expands and exhibits a reduction in pressure. Similarly, fluid passing over rear portion 22 passes over a surface of reducing surface area as the fluid passes over rear portion and back into internal passageway 25. Thus, rear portion 22 can be seen as a higher pressure surface. Fluid passing over rear portion increases its pressure as it passes over a progressively reducing surface area. As fluid passes over outer portion 23, it goes from a gradually decreasing pressure to a gradually increasing pressure.

The principle of operation of the thruster is that as the recirculating fluid 26 passes over the low pressure surface, it entrains any adjacent fluid which in this case is incoming water 17. With the entraining effect, some of the incoming water 17 is accelerated by virtue of it becoming entrained with the high velocity fluid recirculating around curved body 11. This occurs within internal fluid passageway 14 such that the incoming water 17 is accelerated in this area. As the water accelerates through internal fluid passageway 14 and towards outlet 13, the recirculating fluid 26 passes over outer portion 23 and towards rear portion 22. At the rear portion 22, the recirculating fluid increases its pressure by virtue of its moving over a higher pressure surface, and in doing so will jettison any entrained incoming water 17. The accelerated incoming water 17 is then propelled through outlet 13, over after portion 19 and in doing so, provides a forward thrust.

The recirculating fluid 26 is cause to recirculate about curved body 11 by the coanda effect. The recirculating fluid is kept in a high acceleration state by a fluid acceleration means which in the embodiment is in the form of an impeller 28. Impeller 28 is positioned within internal passageway 25 and is driven by motor 29 through connecting shaft 30. Motor 29 locates within after portion 19 and is sealed therein. It is however not essential that motor 29 is part of thruster 10 and it is possible for impeller 28 to be driven externally of the thruster by a motor on the water vessel.

Rotation of impeller 28 causes recirculated fluid to be accelerated and the accelerated fluid passes through a blowing slot 31. Blowing slot 31 is annular in configuration and is positioned adjacent forward portion 21 and in such a way that the high velocity recirculating fluid 26 contacts incoming water 17. A fluid flow divider 32 is positioned adjacent rear portion 22 of curved body 11. The function of divider 32 is to assist in splitting off accelerated incoming water 17 and to assist in guiding recirculating fluid 26 back into internal passageway 25. In the embodiment, an annular shoulder or step 33 is provided immediately in front of blowing slot 31 to assist in the entraining efficiency of incoming water 17.

In use, the marine thruster is immersed in water and water initially flows into internal passageway 14 and into the recirculation passageway. When impeller 28 is rotated at high speed, the water inside the recirculation passageway is accelerated at high speed out through blowing slot 31 and through the coanda effect, the high speed water maintains its contact with curved body 11 and recirculates about curved body 11. As the recirculated water moves at high speed through internal fluid passageway 14, it will entrain and propel incoming water 17. The incoming water is rejected at the fluid divider 32 and is propelled rearwardly of the thruster while the recirculating water recirculates around curved body 11. It is possible for the recirculating fluid to be water, a mixture of water and gas, or entirely a gas. As a marine thruster, it is simpler for the recirculating fluid to simply be a portion of the water.

An advantage of the thruster is that impeller 28 does not directly contact incoming water 17. Thus, should incoming water 17 have some entrained particulate matter such as sand, the sand will not cause damage to impeller 28. Instead, any solid particulate matter will be flung towards shroud 15 due to the centrifugal action of the recirculating water which by virtue of its being accelerated by a rotating impeller, has a centrifugal action. Particulate matter is therefore unlikely to pass under divider 32 and into contact with impeller 28 and is more likely to be accelerated and to pass through outlet 13.

Another advantage of the thruster is that the tapered after body is propelled forward not dissimilar to the effect of squeezing a banana out of its skin. Such propulsion by negative drag (such as in front and thrust from behind) has the additional feature of being virtually wake free.

It should be appreciated that various other changes and modifications may be made to the embodiment without departing from the spirit and scope of the invention.

What is claimed is:

1. A thruster comprising a forward fluid inlet, a rear fluid outlet and an internal fluid passageway through which fluid flows and is accelerated, a curved body positioned between the fluid inlet and fluid outlet and about which fluid can circulate, the curved body having a forward portion adjacent the forward fluid inlet and which is dimensioned to provide a lower pressure surface to the fluid circulating about the curved body, a rear portion adjacent the rear fluid outlet and which is dimensioned to provide a higher pressure surface to the fluid circulating about the curved body, the rear portion being associated with a fluid divider to pass a recirculating portion of the fluid about the curved body, an outer portion between the forward portion and the rear portion and which is in fluid communication with the fluid passageway, an inner portion, and fluid acceleration means to accelerate the fluid about the curved body.

2. The thruster of claim 1, wherein the curved body is a toroid defining a central passageway and the forward fluid inlet and the rear fluid outlet are annular in configuration.

3. The thruster of claim 2, wherein the rear of the thruster has a tapered after portion positioned behind the rear fluid outlet such that fluid exiting from the outlet passes over and exerts pressure on the tapered after portion.

4. The thruster of claim 3, wherein the fluid acceleration means is in the central passageway.

5. The thruster of claim 4, wherein the fluid acceleration means is an impeller.

6. The thruster of claim 4, wherein the forward portion of the curved body is associated with a fluid blowing slot to blow fluid at high velocity over the forward portion, the fluid flow divider passes a recirculating portion of the fluid in the internal fluid passageway into the central passageway for acceleration by the fluid acceleration means towards the fluid blowing slot, and to pass the remainder of the fluid in the internal fluid passageway towards the rear fluid outlet.

7. The thruster of claim 6, suitable for use in a liquid as a marine thruster, whereby incoming fluid flowing through the forward fluid is accelerated in the internal fluid passageway by contact with the recirculating fluid stream and passed out through the rear fluid outlet, the incoming fluid being a liquid.

8. The thruster of claim 7, wherein the recirculating fluid is selected from a liquid, a liquid and gas, or a gas, including steam.

9. The truster of claim 7, wherein an annular step is provided in the curved body adjacent the fluid blowing slot.

10. The thruster of claim 7, wherein the fluid acceleration means is driven by a motor in the thruster.

11. The thruster of claim 7, wherein the fluid acceleration means is driven by a motor external of the thruster.

12. The thruster of claim 7, including a forward cone to assist in the passage of incoming fluid into the forward fluid inlet.

13. A thruster comprising:

an annular forward fluid inlet;

an annular rear fluid outlet;

an internal fluid passageway through which fluid flows and is accelerated;

a tapered after portion positioned behind the rear fluid outlet such that fluid exiting from the outlet passes over and exerts pressure on the tapered after portion;

a curved body positioned between the fluid inlet and the fluid outlet and about which fluid can circulate, the curved body being a toroid defining a central passageway and having, a forward portion adjacent the fluid inlet and which is dimensioned to provide a lower pressure surface to the fluid circulating about the curved body, a rear portion adjacent the rear fluid outlet and which is dimensioned to provide a higher pressure surface to the fluid circulating about the curved body, an outer portion between the forward portion and the rear portion and which is in fluid communication with the internal passageway, and an inner portion;

an impeller located in the central passageway for accelerating fluid about the curved body;

a fluid blowing slot associated with the forward portion of the curved body to blow fluid at high velocity over the forward portion; and a fluid flow divider associated with the rear portion of the curved body to pass a recirculating portion of the fluid in the internal passageway for acceleration by the impeller towards the fluid blowing slot and to pass the remainder of the fluid in the internal passageway towards the rear fluid outlet.

14. The thruster of claim 13, suitable for use in a liquid as a marine thruster, whereby incoming fluid flowing through the forward fluid is accelerated in the internal fluid passageway by contact with the recirculating fluid stream and passed out through the rear fluid outlet, the incoming fluid being a liquid.

15. The thruster of claim 14, wherein the recirculating fluid is selected from a liquid, a liquid and gas, or a gas, including steam.

16. The thruster of claim 14, wherein an annular step is provided in the curved body adjacent the fluid blowing slot.

17. The thruster of claim 14, wherein the fluid acceleration means is driven by a motor in the thruster.

18. The thruster of claim 14, wherein the fluid acceleration means is driven by a motor external of the thruster.

19. The thruster of claim 14, including a forward cone to assist in the passage of incoming fluid into the forward fluid inlet.

* * * * *